United States Patent [19]

Johansing, Jr.

[11] 4,363,356

[45] Dec. 14, 1982

[54] HYDRAULIC FLUID COOLING SYSTEM

[76] Inventor: P. G. Johansing, Jr., 14069 Bayside Dr., Norwalk, Calif. 90650

[21] Appl. No.: 182,009

[22] Filed: Aug. 28, 1980

Related U.S. Application Data

[60] Division of Ser. No. 3,873, Jan. 16, 1979, Pat. No. 4,220,015, which is a continuation of Ser. No. 824,418, Aug. 15, 1977, abandoned.

[51] Int. Cl.[3] ..... B22D 19/00

[52] U.S. Cl. ..... 165/110; 62/310

[58] Field of Search ..... 165/110, 108; 62/310, 62/331, 347, DIG. 10

[56] References Cited

U.S. PATENT DOCUMENTS 2,064,597 12/1936 Engelmann ..... 62/331 X
2,498,017 2/1950 Stutz ..... 62/310 X
3,151,471 10/1964 Weil ..... 62/310 X
3,310,103 3/1967 Osborne ..... 165/110 X
3,996,314 12/1976 Lakmaker ..... 62/310 X

*Primary Examiner*—Lloyd L. King
*Attorney, Agent, or Firm*—Fraser and Bogucki

[57] ABSTRACT

A system for operating a hydraulic tool is disclosed in which heated hydraulic fluid being returned to a fluid reservoir from the tool is cooled by a refrigeration system. The heated hydraulic fluid is introduced into the hollow interior of a distributor from which the fluid exits through a plurality of orifices in a planar side in the form of plural sprays directed onto adjacent portions of a coil carrying evaporating refrigerant. The sprays flow over the coil to effect substantial transfer of heat from the hydraulic fluid to the refrigerant, with the cooled hydraulic fluid being stored in the reservoir prior to being pumped to the hydraulic tool as needed.

5 Claims, 5 Drawing Figures

HYDRAULIC FLUID COOLING SYSTEM

This application is a division of Ser. No. 3,873, filed Jan. 16, 1979, now U.S. Pat. No. 4,220,015. Ser. No. 3,873 is a continuation of Ser. No. 824,418, filed Aug. 15, 1977, now abandoned.

BACKGROUND OF THE INVENTION

1. Field of the Invention

The present invention relates to hydraulic systems, and more particularly to hydraulic tools which require a means for cooling the hydraulic fluid.

2. History of the Prior Art

Tools such as chain saws, railroad tie pullers, jackhammers and the like are capable of being powered by a number of different sources including gasoline engines, electric motors, pneumatic systems and hydraulic systems. For most power tools, and particularly for those requiring substantial amounts of power, hydraulic operation is potentially advantageous for a number of reasons including the fact that large amounts of power can be provided the tool from a hydraulic system of given size. In a pneumatic system a like amount of power typically requires equipment of considerably larger size. Such factors become important not only in terms of the cost of the power equipment required, but particularly in terms of the size and weight of the equipment required to be transported by truck or other means to various job sites.

While hydraulic systems have proven to be efficient and effective power sources in many respects, they also have cooling problems which may make them unsuitable or undesirable for certain applications such as those in which the ambient temperature is relatively high. As the hydraulic fluid is pumped under substantial pressure to the tool, used in the tool and then returned to a reservoir for storage prior to recirculation, it becomes heated. The heated fluid becomes uncomfortable and poses a potential danger to workmen and other personnel, particularly if the temperature becomes too high and one or more portions of the system become prone to leaking or bursting. Moreover, as the hydraulic fluid is heated to higher temperatures, the viscosity thereof changes such that is poses even greater leakage problems.

Various techniques are commonly employed to cool hydraulic fluid including an arrangement in which the hot fluid is fed into a radiator-type structure having plural fins in contact with a coil through which the heated fluid flows. A multiplicity of small elements in the flow path of the hydraulic fluid attempt to create a turbulence so as to enhance transfer of heat from the hydraulic fluid to the air surrounding the radiator-like structure. While such cooling techniques are adequate for certain applications including most applications where ambient temperature is relatively low, they have proven to be inadequate for various applications and particularly those where ambient temperature is relatively high. For example, such cooling arrangements are typically capable of reducing the temperature of the hot hydraulic fluid to within 40°-50° F. of ambient temperature and no more. If the temperature on a street corner where a jackhammer or other tool is being used is 90°-100° F. on a summer day, it may be impossible to cool the hydraulic fluid below about 140°-150° F. Experiments have shown that temperatures in excess of about 114° F. produce discomfort among workers. Such temperature levels, aside from making workmen uncomfortable because of the heat given off by the equipment, may not only be dangerous but may violate various health and safety standards.

Accordingly, it would be desirable to be able to provide a hydraulic system in which heated hydraulic fluid is efficiently and effectively cooled to safe and comfortable levels despite the presence of relatively high ambient temperatures.

DESCRIPTION OF THE INVENTION

Hydraulic systems in accordance with the invention advantageously employ a refrigeration system to cool the heated hydraulic fluid in a manner which is relatively efficient and very effective. Apparatus is employed to create a high-contact flow of the hot hydraulic fluid over a refrigerant carrying conduit member so as to maximize heat transfer between the hydraulic fluid and the refrigerant.

The refrigeration system includes a compressor for compressing the refrigerant, a condensor for condensing the compressed refrigerant and an evaporator preferably located within a reservoir for storing the hydraulic fluid. A valve at the entrance to the evaporator meters the amount of refrigerant flowing into the evaporator in accordance with the temperature of refrigerant exiting the evaporator and returning to the compressor.

In a preferred embodiment, the evaporator comprises a hollow coil disposed adjacent a hollow distributor within the fluid reservoir. Hot hydraulic fluid returning to the reservoir from the tool or other utilization device within the hydraulic system flows into the hollow interior of the distributor from which it exits in the form of a plurality of sprays via plural orifices in a generally planar wall of the distributor. The sprays are directed onto various portions of the coil in such a way that contact between the hydraulic fluid and the coil is maximized. The orifices are arranged into rows with various portions of the coil disposed within a first plane being disposed adjacent the different ones of the rows of orifices for receiving the sprays therefrom. Still other portions of the coil disposed in one or more additional planes more remotely located relative to the orifices are positioned to receive portions of the sprays deflected by the first group of coil portions so as to further enhance heat transfer from the hydraulic fluid to the refrigerant within the coil.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
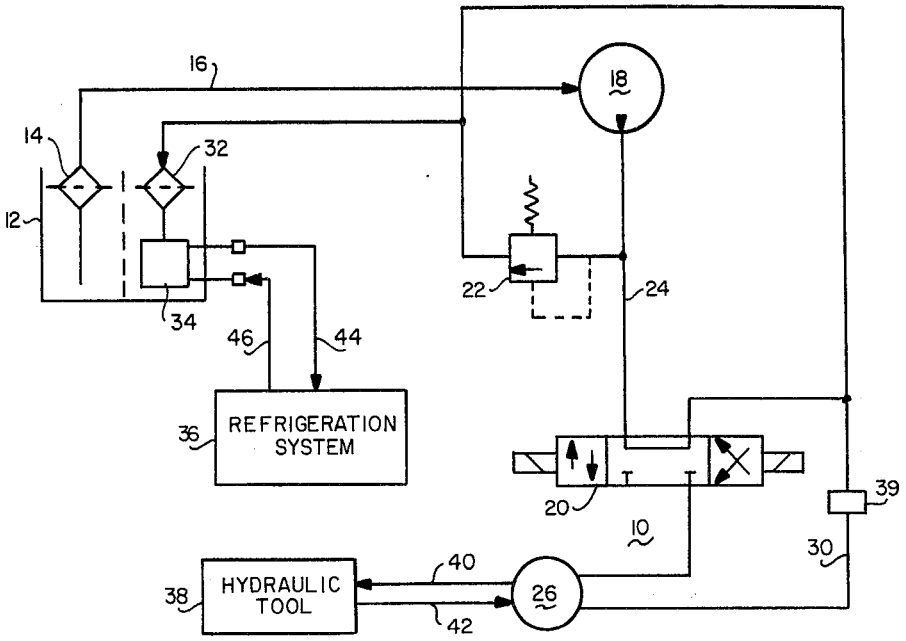
FIG. 1 is a partial schematic and partial block diagram of a hydraulic system in accordance with the invention.

FIG. 1 depicts a hydraulic system 10 in accordance with the invention. The hydraulic system 10 includes a reservoir 12 for storing hydraulic fluid. The reservoir 12 includes an outlet suction filter 14 coupled to one end of a conduit 16 extending between the reservoir 12 and a pump 18. The pump 18 is coupled to a selector valve 20 and a relief valve 22 via a conduit 24. The selector valve 20 is coupled to a hose reel 26 via a conduit 28. The hose reel 26 is also coupled directly to the reservoir 12 via a conduit 30 which is also coupled to the input side of the selector valve 20 and to the relief valve 22. Within the reservoir 12 the conduit 30 extends through an inlet suction filter 32 and terminates at an evaporator 34.

Except for the presence of the evaporator 34 and an associated refrigeration system 36, the hydraulic system 10 of FIG. 1 is of conventional design. The selector valve 20 normally couples the reservoir 12 to the hose reel 26 so that the pump 18 can pump hydraulic fluid to the hose reel 26 via the outlet suction filter 14 and the conduits 16, 24 and 28. The hose reel 26 is adapted to be coupled to a hydraulic tool 38 or other utilization device via a hose 40 which couples the tool 38 to the conduit 28. A second hose 42 provides a return path for the hydraulic fluid by coupling the hydraulic tool 38 to the conduit 30 via the hose reel 26. The conduit 30 returns the hydraulic fluid to the reservoir 12 via the inlet suction filter 32. The hydraulic tool 38 may comprise any conventional hydraulic tool such as a hydraulic chain saw, a railroad tie puller or a jackhammer.

The selector valve 20 can be adjusted to couple the conduit 24 to the return conduit 30 when desired. In the event of high fluid temperature, the selector valve 20 diverts fluid directly into the conduit 30, thereby avoiding the hose reel 26 and the hydraulic tool 38. A temperature switch 39 is located in the conduit 30 to sense the temperature of returning fluid.

The release valve 22 senses a buildup of excessive pressure at the output side of the pump 18 and relieves such pressure by venting the output of the pump 18 to the reservoir 12 via the return conduit 30.

Use of the hydraulic tool 38 and environmental conditions surrounding the hydraulic system 10 cause the hydraulic fluid to heat up. If the fluid becomes too hot it loses its viscosity and may begin to leak out of the various joints and components within the system, resulting in additional heating of the fluid because of the high leakage velocity when under working pressure. At the same time, excessive fluid temperatures result in the radiation of considerable amounts of heat by the system, and in particular pose a threat of physical injury to the operator of the hydraulic tool and possibly others in the area if a portion or portions of the system leak excessively or fail allowing the hot hydraulic fluid to escape.

In accordance with the invention the hydraulic fluid in the system 10 is continually cooled to safe levels by the refrigeration system 36 and its included evaporator 34. The refrigeration system 36 compresses and condenses a refrigerant which is then fed via a tube 44 to the evaporator 34 where the evaporating refrigerant absorbs heat from the hot hydraulic fluid returning to the reservoir 12 via the conduit 30. The refrigerant is returned to the refrigeration system 36 from the evaporator 34 via a tube 46.

Figure 2:
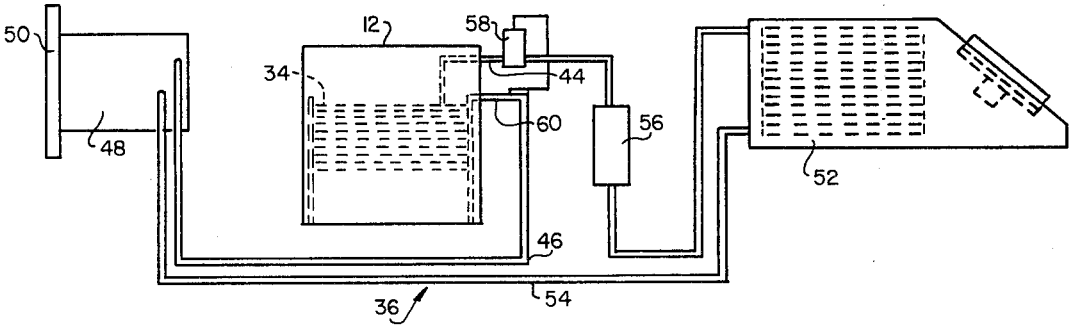
FIG. 2 is a schematic diagram of a portion of the system of FIG. 1 including the refrigeration system.

FIG. 2 depicts the refrigeration system 36 in detail. With the exception of the design of the evaporator 34, the refrigeration system 36 is made up of conventional components. The tube 46 from the evaporator 34 is coupled to the input of a conventional compressor 48. The compressor 48 has a pulley 50 coupled to be driven by an appropriate source of power such as a gas engine. The compressor 48 compresses the refrigerant carried thereto from the evaporator 34 by the tube 46 and provides the compressed refrigerant to a condensor 52 via a tube 54. The condenser 52 insures that refrigerant from the compressor 48 is condensed prior to providing it to the evaporator 34 via a drying element 56 and a temperature sensitive valve 58. The valve 58 meters the flow of refrigerant into the evaporator 34 in accordance with the temperature of the refrigerant at the output end 60 of the evaporator 34. The higher the temperature of the refrigerant at the output end 60 the greater is the amount of refrigerant from the condensor 52 admitted to the evaporator 34 by the valve 58.

Figure 5:
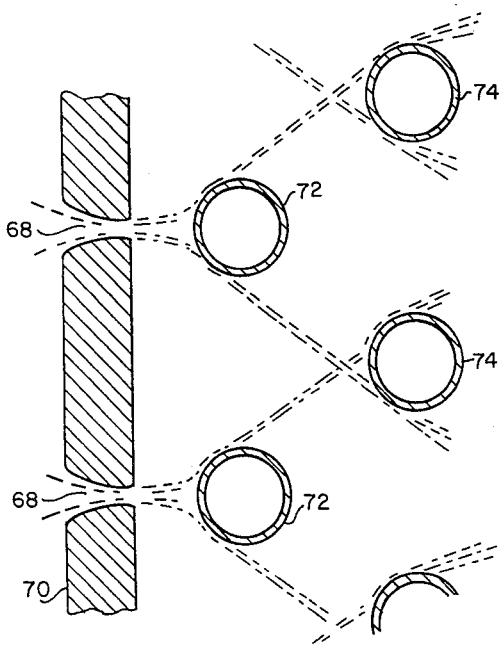
FIG. 5 is a greatly enlarged view of a portion of FIG. 4.
Figure 3:
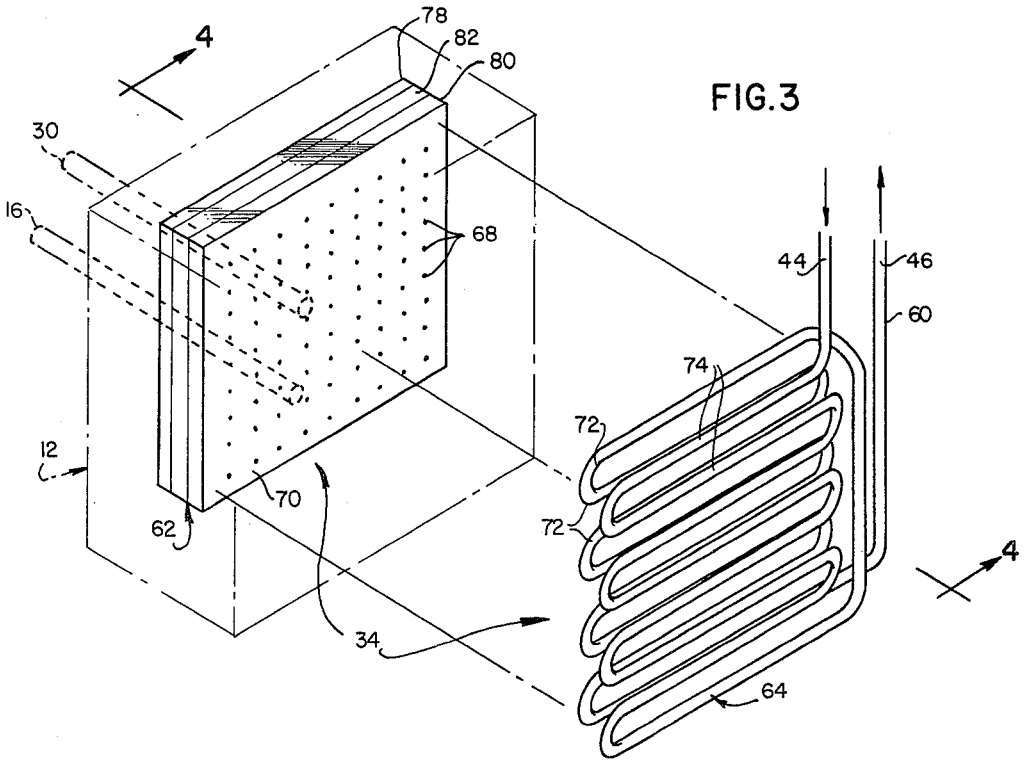
FIG. 3 is a perspective, exploded view of a portion of the system of FIG. 1 including an evaporator for the refrigeration system and its disposition relative to a hydraulic fluid reservoir.
Figure 4:
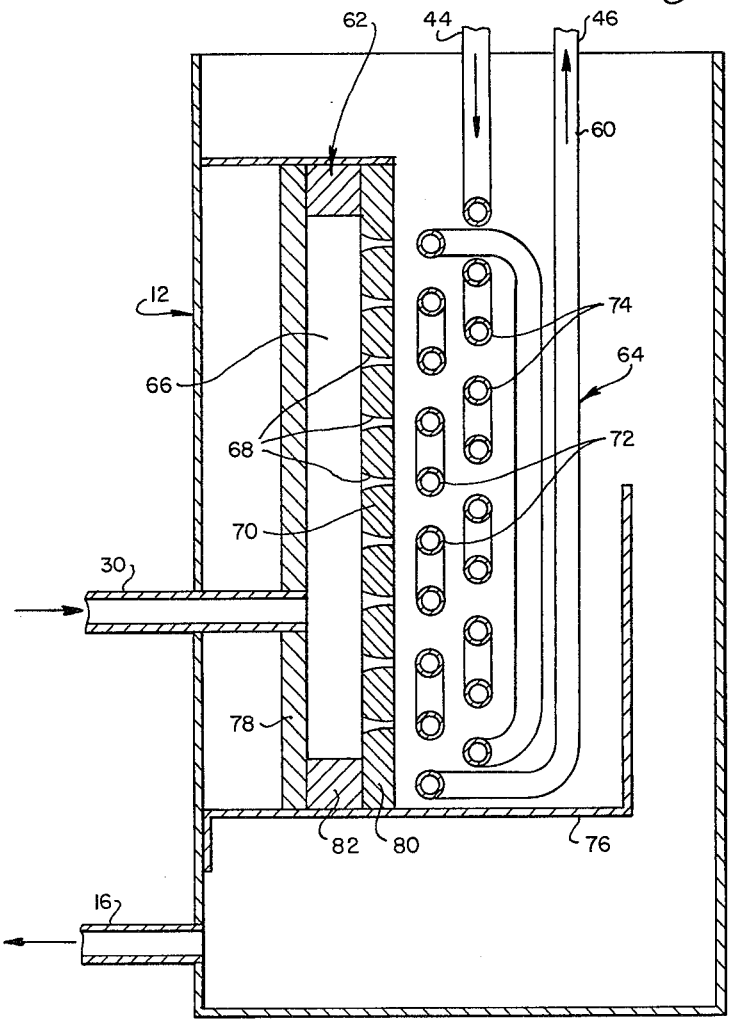
FIG. 4 is a sectional view of the arrangement of FIG. 3 taken alone the line 4—4 thereof.

FIGS. 3, 4 and 5 depict a preferred arrangement of the reservoir 12 and the evaporator 34 in accordance with the invention. The reservoir 12 comprises a generally rectangular enclosure which is shown in dotted outline only for clarity of illustration in FIG. 3. The evaporator 34 includes a distributor 62 and a coil 64, both of which are completely contained within the reservoir 12. The distributor 62 comprises a relatively thin, generally planar structure having a hollow interior 66 communicating with the conduit 30 so as to receive the hot hydraulic fluid being returned to the reservoir 12 from the hydraulic tool 38. The hot hydraulic fluid within the interior 66 of the distributor 62 is forced through a plurality of orifices 68 within a generally planar wall 70 of the distributor 62. The orifices 68 extend from the outside of the distributor 62 into the hollow interior 66 and form the hot hydraulic fluid into a plurality of generally parallel sprays.

The coil 64 which is coupled between the tubes 44 and 46 to receive refrigerant from the refrigeration system 36 includes a first plurality of spaced-apart, parallel straight portions 72 thereof disposed within a common first plane spaced-apart from and parallel to the generally planar wall 70 of the distributor 62. As seen in FIG. 3 the orifices 68 are generally uniformly spaced in a grid pattern so as to define rows and columns thereof. Each row of orifices is parallel to the other rows and is disposed adjacent a different one of the straight portions 72 of the coil 64. This results in the sprays from the orifices in that particular row being directed onto the adjacent straight portion 72.

The coil 64 is also comprised of a second plurality of interconnected straight portions 74 thereof disposed in generally parallel, spaced-apart relation within a common second plane parallel to and disposed on the opposite side of the first plurality of straight portions 72 from the generally planar wall 70. Accordingly, the straight portions 74 are spaced a uniform distance from the planar wall 70, which distance is greater than the uniform distance by which the straight portions 72 are spaced from the planar wall 70. In addition, each of most of the straight portions 74 is disposed between a different pair of the straight portions 72. As seen in FIG. 5 this disposes each of the straight portions 74 in the path of one or more of the sprays from the orifices 68 as deflected by the first plurality of straight portions 72. This particular arrangement has been found to provide a substantial amount of heat transfer between the hydraulic fluid being sprayed out of the orifices 68 and the refrigerant which flows through the straight portions 72 and 74 of the coil 64. This is due partly to the fact that all or substantially all of the hydraulic fluid comes forcefully into contact with the coil 64 one or more times. As each spray strikes the adjacent one of the straight portions 72, there is a flow of the spray around both sides of the straight portion 72. The spray is thus split in half and the two halves of the spray are directed onto different ones of the straight portions 74 where they flow over the straight portions 74.

Referring again to FIG. 4 the lower portion of the coil 64 is enclosed by a baffle 76 which extends outwardly from one of the walls of the reservoir 12 via the underside of the distributor 62 which the baffle helps to support. As the hot hydraulic fluid is sprayed onto the various straight portions of the coil 64, it flows from the coil and over the baffle 76. As the hydraulic fluid thus cooled by the coil 64 rises to the top of the baffle 76, the fluid flows over the top and down to the bottom of the reservoir 12 where it exits via the conduit 16 to the pump 18.

To further maximize heat transfer between the hydraulic fluid and the refrigerant, the coil 64 is arranged to present the coldest refrigerant to the cooler portions of the hydraulic fluid sprays and the warmer portions of the refrigerant to the warmer portions of the hydraulic fluid sprays. This is accomplished by configuring the coil 64 such that the cold refrigerant from the condensor 52 enters the coil 64 and flows through the second plurality of straight portions 74 which comes in contact with the sprays of hydraulic fluid after they have already been cooled substantially by the first plurality of straight portions 72. The refrigerant which is warmed somewhat by the second plurality of straight portions 74 flows into the first plurality of straight portions 72 where it absorbs a substantial amount of heat from the hot hydraulic fluid as the fluid is sprayed from the orifices 68.

The number of the orifices 68 and the size thereof are chosen so as to establish a pressure differential between the input end of the distributor 62 at the conduit 30 and the output of the reservoir 12 at the conduit 16 which is relatively small and yet great enough to create the sprays. It has been found that a relatively small pressure drop will provide the desired laminar flow though the orifices 68 that results in a strong spray. If the pressure within the distributor 62 becomes too large such as may result from too few of the orifices 68 or orifices 68 of insufficient diameter, not only is there a danger of the distributor 62 rupturing but the flow of hydraulic fluid through the orifices 68 becomes turbulent rather than laminar and the sprays are thereby weakened or destroyed.

The low pressure differential in evaporator arrangements according to the invention enables such arrangements to be used in high pressure as well as low pressure parts of hydraulic and other systems. For example, a distributor tube having plural orifices can be mounted parallel to an evaporator cooler tube within an elongated pressure vessel. The small pressure drop across the plural orificed distributor tube does not significantly reduce the pump pressure, while at the same time allowing the pressurized fluid to be cooled directly after the pump.

As seen in FIGS. 3 and 4 the distributor 62 is of thin, planar configuration and is comprised of an opposite pair of thin, planar sheets 78 and 80. The sheet 80 defines the generally planar wall 70. The sheets 78 and 80 are held in spaced-apart relation by a plurality of elongated spacing elements 82 extending around the outer peripheries of the sheets 78 and 80.

In one preferred arrangement of an evaporator constructed and successfully tested in accordance with the invention, the distributor 62 measures approximately 15"×15" and has a total thickness of 0.875". The sheets 78 and 80 are of aluminum having a thickness of 0.250", and the elongated spacing elements 82 have a width of 0.75" and a thickness of 0.375". The coil 64 is copper construction and has an outer diameter of 0.50" and a wall thickness of 1/16". The orifices 68 are disposed approximately 1.5" apart and there are 81 such orifices in the planar wall 70. The first plurality of straight portions 72 are disposed approximately $\frac{3}{8}$" from the outer surface of the planar wall 70, while the second plurality of straight portions 74 are disposed approximately $\frac{5}{8}$" from the outer surface of the planar wall 70. The orifices 68 have a varying diameter which tapers from a maximum of 0.250" at the inner surface of the planar wall 70 to a nominal diameter of 0.0625". With ARCO DURO S105 hydraulic fluid having a viscosity of 105 Saybolt Universal Seconds used in the hydraulic system, the pressure differential across the distributor-reservoir combination was less than 10 psi and typically on the order of 2 psi or less. The system has flow rate capability of 0.5–14 G.P.M. making it suitable for a variety of conditions including pump standby where the case drain fluid which has a flow rate on the order of 0.5 G.P.M. quickly heats up where prior art cooling systems are used because of their inability to provide adequate heat exchange at such low flow rates.

It has been found that a refrigeration system of approximately 2 tons (24,000 BTU/Hr.) capacity provides adequate cooling of the hydraulic fluid for most hydraulic tool applications. An example of a refrigeration system 36 having approximately that capacity and which was constructed and successfully tested in accordance with the invention included a compressor 48 of 2 tons capacity made by Sankyo Company. This condenser 52 was also of 2 tons capacity. The temperature sensitive valve 58 was of the external equalized type. The coolant comprised Freon 12.

While the invention has been particularly shown and described with reference to a preferred embodiment thereof, it will be understood by those skilled in the art that various changes in form and details may be made therein without departing from the spirit and scope of the invention.

What is claimed is:

1. A heat exchange system comprising the combination of:

a reservoir capable of containing a first fluid and including means for discharging the first fluid therefrom; and a distributor disposed within the reservoir, the distributor having a hollow interior coupled to receive a supply of the first fluid and having a plurality of orifices in a generally planar wall thereof for directing fluid received therein out of the distributor in a plurality of streams in a substantially completely liquid form, a coil of hollow tubing having opposite first and second ends and disposed within the reservoir adjacent the distributor and in the path of the plurality of streams, the hollow tubing having a central axis, each of the orifices having a central axis, the central axes of some of the orifices substantially intersecting the central axis of the hollow tubing, portions of the hollow tubing adjacent at least some of the orifices being spaced apart from the distributor by a distance not substantially greater than the outer diameter of the hollow tubing, the coil being adapted to receive a second fluid therein, whereby heat exchange occurs between the first and second fluids.

2. The invention set forth in claim 1, wherein the orifices are arranged in parallel rows with each row having a plurality of orifices therein, and the coil includes a plurality of connecting straight portions thereof, each of which is disposed adjacent and parallel to a different one of the rows of orifices.

3. A heat exchange system comprising the combination of:

a first enclosed chamber having a hollow interior coupled to receive a supply of a first fluid and having a plurality of orifices in a wall thereof, at least some of the orifices tapering in diameter from a large diameter at the hollow interior of the chamber to a small diameter at the exterior of the chamber, the first fluid exiting the first enclosed chamber through the orifices in a substantially completely liquid form;

a second enclosed chamber having a hollow interior coupled to receive a supply of a second fluid, the second enclosed chamber being disposed outside of and adjacent the first enclosed chamber and having different portions thereof disposed adjacent the different ones of the plurality of orifices in the first enclosed chamber, each of the different portions of the second enclosed chamber being spaced apart from different ones of the plurality of orifices by a distance not substantially greater than the large diameter of the orifice; and a collecting structure enclosing at least a part of the second enclosed chamber and operative to collect the first fluid after exiting the first enclosed chamber via the orifices and striking and flowing over a portion of the second enclosed chamber.

4. The invention set forth in claim 3, wherein the second enclosed chamber is comprised of a plurality of different lengths of hollow tubing with each of the different lengths of hollow tubing being disposed adjacent a different group of the plurality of orifices.

5. The invention set forth in claim 3, wherein each of the plurality of orifices is tapered so as to gradually decrease in size as it extends through a portion of the thickness of the wall from the inside to the outside of the first enclosed chamber.

* * * * *